United States Patent [19]

Kennedy

[11] Patent Number: 4,538,921

[45] Date of Patent: Sep. 3, 1985

[54] APPARATUS AND METHOD FOR SLURRYING SODA ASH

[75] Inventor: David K. Kennedy, Liverpool, N.Y.

[73] Assignee: Allied Corporation, Morris Township, Morris County, N.J.

[21] Appl. No.: 555,322

[22] Filed: Nov. 25, 1983

[51] Int. Cl.[3] ..... B01F 5/04

[52] U.S. Cl. ..... 366/178; 239/112; 239/424; 366/138

[58] Field of Search ..... 366/150, 177, 178, 181, 366/183, 173, 167, 182, 138; 239/424, 112

[56] References Cited

U.S. PATENT DOCUMENTS

| | | | |
|---|---|---|---|
| 2,024,830 | 12/1935 | McCann | 22/239 |
| 2,043,710 | 6/1936 | Rowland | 22/268 |
| 3,038,785 | 6/1962 | Braude | 239/424 |
| 3,298,669 | 1/1967 | Zingg | 366/177 |
| 3,357,801 | 12/1967 | Weed et al. | 23/312 |
| 3,542,342 | 1/1970 | Barron | 366/178 |
| 3,741,533 | 6/1973 | Winn | 366/178 |
| 3,802,848 | 4/1974 | Weeks et al. | 423/208 |
| 3,891,393 | 6/1975 | Weeks et al. | 23/271 R |
| 3,980,233 | 9/1976 | Simmons | 239/424 |

*Primary Examiner*—Robert W. Jenkins

*Attorney, Agent, or Firm*—R. C. Stewart, II; J. P. Friedenson

[57] ABSTRACT

This invention relates to an improved soda ash slurrying device, which includes liquid and soda ash particle passages and separating means positioned between the interior openings of these passages to prevent contact between water or aqueous sodium carbonate solution and soda ash particles prior to their exiting the openings of the passages.

14 Claims, 1 Drawing Figure

APPARATUS AND METHOD FOR SLURRYING SODA ASH

BACKGROUND OF THE INVENTION

1. Field of the Invention

The invention covers a method for preparing slurries of soda ash and water and the apparatus for effecting these slurries.

2. Description of the Prior Art

It is known that soda ash can be stored and dispensed in the form of an aqueous mixture. Upon mixing sufficient soda ash with water at temperatures greater than 35° C., part of the soda ash dissolves to form a saturated sodium carbonate solution while the remainder, which does not dissolve, is converted to particles of sodium carbonate monohydrate that settle to the bottom of the mixture as a fluid, non-hardening slurry.

This method of storage is desirable because the slurry has a considerably higher apparent density than the dry soda ash from which it was made. As a result it is possible to store up to twice the soda ash in a given volume as a slurry rather than in its dry form. The soda ash is recovered from the storage tank by removing the upper layer of saturated soda ash solution. In many cases the uniformity of the saturated soda ash solution permits dispensing of the soda ash volumetrically with acceptable accuracy. Typical methods for storing and withdrawing of soda ash slurries are described in U.S. Pat. Nos. 3,357,801; 3,802,848; 3,891,393; 2,024,830; and 2,043,710.

The soda ash is replenished in the storage tank most conveniently by mixing soda ash (conveyed via air) and water to form a slurry using some sort of injection device, as for example a nozzle. This method of addition increases the amount of both saturated soda ash and sodium carbonate monohydrate crystals in the storage tank.

Several difficulties are associated with these known methods and apparatus for slurrying soda ash. For example, one of the difficulties which has arisen in these systems has been in slurrying the soda ash properly with water or an aqueous sodium carbonate solution prior to introducing the soda ash into the storage tank without clogging the slurry injecting device. Prior art nozzle designs permit contact of the soda ash and solution as early as the end of the nozzle. This results in a build-up of wet, caked soda ash at the end of the nozzle, and plugging of the air-soda ash line results. This necessitates frequent shut down for unclogging purposes and increases process cost. As a result, it is desirous to develop a process and apparatus for forming and injecting soda ash slurries into storage tanks which alleviate the clogging problem.

SUMMARY OF THE INVENTION

In accordance with this invention there is provided an improved soda ash slurrying system of the type in which soda ash particles are slurried with water or an aqueous sodium carbonate solution, and said slurry is thereafter injected into a storage tank by means of an injection nozzle, said improvement comprising at least one nozzle extending through an opening in said tank, said nozzle comprising a housing having at least one liquid passage and at least one soda ash particle passage therethrough, one opening of each of said passages in the interior of said tank and the other opening of each of said passages to the outside of said tank, said liquid passage providing for communication between the interior of said tank and a source of water and/or an aqueous sodium carbonate solution and said soda ash particle passage providing for communication between the interior of said tank and a source of soda ash particles, said liquid passage and said soda ash particle passage being positioned such that liquid passing through said liquid passage into the interior of said tank and solid soda ash particles passing through said particle passage into the interior of said tank contact and form a slurry on exiting the interior opening of said passages, said nozzle further comprising means for preventing said soda ash and said water or aqueous sodium carbonate from contacting before they exit the interior openings of said passages.

DESCRIPTION OF THE INVENTION AND THE PREFERRED EMBODIMENTS

Figure 1:
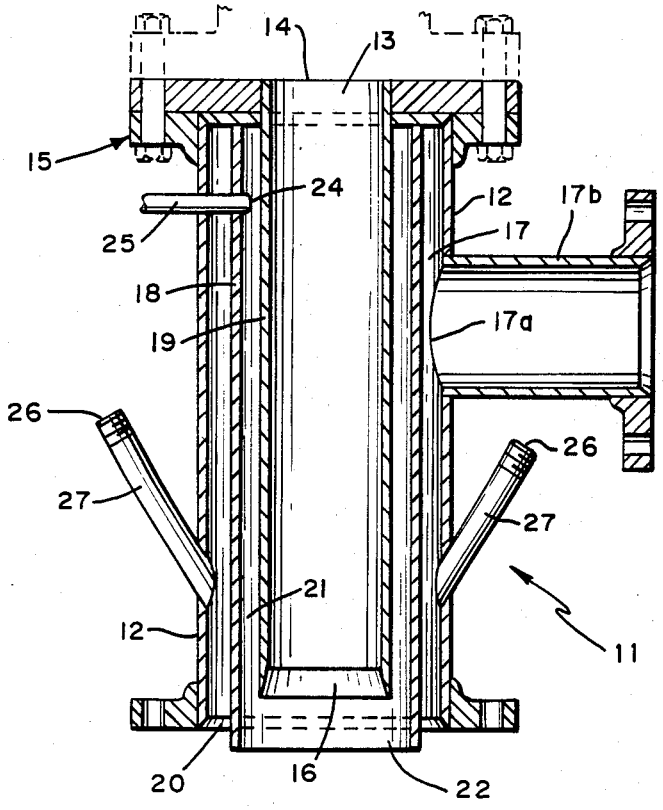
FIG. 1 is a sectional view of a soda ash slurrying and injection nozzle.

The invention can best be described by reference to the attached drawing. The slurry nozzle which is shown in the drawing is fitted atop a storage tank, not shown, so that the final slurry is fed by gravity downward into the storage tank. The soda ash particles are conveyed through a conduit, not shown, from a bulk pneumatic transport, bulk hopper car, storage bin or feed hopper by air conveying or other known techniques for moving dry particles through a conduit.

The nozzle 11 is made up of a housing 12, having a passage 13 therethrough. In the preferred embodiment of the drawing, passage 13, formed by inner wall 19, is a substantially cylindrical passage, which extends along the longitudinal axis of nozzle 11. Passage 13 has an opening 14, which is fitted with connecting means 15 for connecting the passage to a conduit in communication with a source of soda ash particles. Passage 13 also has an interior opening 16, which is in communication with the interior of a soda ash slurry tank. The interior opening 16 includes some means for connecting the nozzle to an opening in the top of the tank. Concentrically positioned about the passage 13 is liquid passage 17 which is formed by inner wall 18 of housing 12 and the housing 12 defining passage 17. Passage 17 also includes an opening 20 in communication with the interior of the storage tank, which opening is as positioned concentrically about interior opening 16 of passage 13. Passage 17 includes and exterior opening 17(*a*), which is in liquid communication with a source of water and/or an aqueous soda carbonate solution by way of side arm 17(*b*). Positioned concentrically between passages 13 and 17 is passage 21, which is formed by the inner wall of passage 17 and the outer wall of passage 13. The passage 21 has an interior opening 22 also in communication with the interior of the tank and concentrically positioned between opening 20 of passage 17 and opening 16 of passage 13. The inner wall 23 of passage 17 projects somewhat further into the tank than the other exterior and interior walls of the housing, and this extension 23 functions as a separating means to prevent contact between liquid exiting opening 20 and the soda ash particles exiting opening 16 before they exit the openings 16 and 20 and, thus, to prevent or retard clogging of the openings. Air passage has an opening 24, which communicates with a fresh water system by way of enclosed wash-out tubing 25. Water and/or aqueous solution passage 20 has openings 26, which similarly communicate with a fresh water system by way of enclosed wash-out tubing 27.

In operation soda ash particles are conveyed through a conduit, not shown, from a transport, rail car or other source of soda particles by air conveying or other known techniques for moving dry particles through a conduit to the opening 14 of passage 13. The soda ash particles traverse passage 13 and exit the passage by way of interior opening 16. Simultaneously, water or an aqueous soda ash solution is conveyed from a source of such materials and is introduced in opening 17(*a*) of passage 17 by way of side arm 17(*b*). The liquid traverses the longitudinal axis of passage 17 and exits the passage via opening 20 into the interior of the tank. As was noted hereinabove, openings 16 and 20 are positioned such that soda ash particles do not contact the liquid either in the nozzle or in the opening but rather just after the materials exit the openings because of the air barrier passage 21. This results in a significant reduction in clogging.

At the same time, the system provides for a proper slurrying of the soda ash with water or the aqueous solution as to provide a thorough wetting and dispersion of the dry soda ash in the liquid to avoid caking or lumping of the soda ash. Such caking is undesirable because such caked agglomerates may be converted to sodium carbonate monohydrate only at their surface. The agglomerates contain undissolved soda ash in their center in a form which does not dissolve readily. This reduces the rate at which soda ash can be dissolved and thereby reduces the throughput rate of the system.

In the operation of the slurrying apparatus, the liquid which is used to form the soda ash slurry can be either water or a sodium carbonate solution. Normally, some of the sodium carbonate solution which is in the storage tank is recirculated through the conduits 12 in order to make up additional soda ash slurry. Water may be added as is needed to regulate the depth of the sodium carbonate solution layer, which is desired for recirculation in the storage facility and subsequent use.

What is claimed is:

1. In an improved nozzle for use in a soda ash slurrying system of the type in which soda ash particles are slurried with water or an aqueous sodium carbonate solution, and said slurry is thereafter injected into a slurry storage tank by means of said nozzle, said nozzle of the type which extends through an opening in said tank, said improvement comprising a nozzle which comprises a housing, having at least one liquid passage and at least one soda ash particle passage therethrough, one opening of each of said liquid and soda ash particle passages for communication with the interior of a tank, and the other opening of said liquid passage for liquid communication with a source of water and/or an aqueous solution of sodium carbonate, and the other opening of said soda ash particle passage for communication with a source of soda particles, the interior openings of said liquid and soda ash particle passages being positioned such that water or aqueous soda ash solution, and soda ash particles exiting said interior openings contact forming a soda ash slurry, and said nozzle further comprising separating means for preventing said soda ash and said water or aqueous sodium carbonate solution from contacting before they exit the interior opening of said passages or at said opening.

2. An improved slurrying system according to claim 1 wherein separating means for preventing said water or aqueous sodium carbonate solution and said soda ash particles from contacting before they exit the interior openings of said passages comprises a partitioning structure positioned between said openings.

3. An improved soda ash slurrying system according to claim 1 wherein said soda ash particle passage is positioned substantially along an axis of said nozzle.

4. An improved soda ash slurrying system according to claim 3 wherein said soda ash particle passage is positioned substantially cylindrically along the longitudinal axis of said nozzle.

5. An improved soda ash slurrying system according to claim 4 wherein at least the portion of said liquid passage which is immediately adjacent to the interior opening of said liquid passage is positioned along an axis of said nozzle.

6. An improved soda ash slurrying system according to claim 5 wherein said portion of said passage is positioned cylindrically along the longitudinal axis of said nozzle.

7. An improved soda ash slurrying system according to claim 1 wherein said soda ash particle passage and at least that portion of said liquid passage immediately adjacent to the interior opening of said passage are positioned along an axis of said nozzle in substantially parallel alignment.

8. An improved soda ash slurrying system according to claim 7 wherein said soda ash particle passage and said portion of said liquid passage are cylindrical.

9. An improved soda ash slurrying system according to claim 8 wherein said portion of said liquid passage is positioned concentrically about said soda ash particle passage.

10. An improved slurrying system according to claim 9 wherein said separating means for preventing contact between said water or aqueous sodium carbonate and said soda ash particles before they exit the interior openings of said interior openings comprises an annular flange positioned between said concentrically positioned liquid and soda ash particle passages.

11. An improved slurrying system according to claim 10 wherein said portion of said liquid passage and said soda ash particle passage are adjacent.

12. An improved slurrying system according to claim 11 wherein said portion of said concentrically positioned liquid passage and said soda ash particle passage are separated by a partitioning annular hollow cylindrical body, the interior surface of said body forming the outer wall of said soda ash particle passage and the outer surface of said body forming the inner wall of said portion of said liquid passage.

13. An improved slurrying system according to claim 11 wherein said separating means comprises a projection of said annular hollow cylindrical body into said tank beyond the interior openings of said liquid and soda ash particle passages.

14. In an improved nozzle for use in a soda ash slurrying system of the type in which soda ash particles are slurried with water or an aqueous sodium carbonate solution, and said slurry is thereafter injected into a slurry storage tank by means of said nozzle, said nozzle of the type which extends through an opening in said tank, said improvement comprising a nozzle which comprises a housing, having at least one liquid passage and at least one soda ash particle passage therethrough, one opening of each of said liquid and soda ash particle passages for communication with the interior of a tank, and the other opening of said liquid passage for liquid communication with a source of water and/or an aqueous solution of sodium carbonate, and the other opening of said soda ash particle passage for communication with a source of said particles, the interior openings of said liquid and soda ash particle passages being positioned substantially along an axis of said nozzle in concentric relation such that water or aqueous soda ash solution and soda ash particles exiting said interior openings contact, forming a soda ash slurry, and said nozzle further comprising separating means for preventing said soda ash and said water or aqueous sodium carbonate solution from contacting before they exit the interior opening of said passages or at said openings, said separating means comprising a partitioning structure positioned between said openings and projecting from said openings exterior of said nozzle.

* * * * *